US006006771A

United States Patent [19]

Wu

[11] Patent Number: 6,006,771

[45] Date of Patent: Dec. 28, 1999

[54] SAFETY UMBRELLA RUNNER

[76] Inventor: Tzun-Zong Wu, 8F, No. 76, Lane 103, Nei-Hu Road, Sec. 2, Taipei, Taiwan

[21] Appl. No.: 09/128,724

[22] Filed: Aug. 3, 1998

Related U.S. Application Data

[63] Continuation-in-part of application No. 09/040,373, Mar. 18, 1998, Pat. No. 5,911,233.

[51] Int. Cl.[6] ..... A45B 25/08

[52] U.S. Cl. ..... 135/41; 135/28; 135/39; 135/40

[58] Field of Search ..... 135/28, 37, 38, 135/39, 40, 41

[56] References Cited

U.S. PATENT DOCUMENTS

| | | | |
|---|---|---|---|
| 196,586 | 10/1877 | Knapp . | |
| 3,856,032 | 12/1974 | Schafer . | |
| 5,566,699 | 10/1996 | Kou | 135/28 |
| 5,588,455 | 12/1996 | Kuo | 135/28 |
| 5,732,725 | 3/1998 | Ko | 135/41 X |
| 5,740,824 | 4/1998 | Tang | 135/39 X |

*Primary Examiner*—Carl D. Friedman
*Assistant Examiner*—Yvonne Horten-Richardson

[57] ABSTRACT

A safety umbrella runner includes: a runner tube slidably held on a central shaft of the umbrella; a ferrule integrally circumferentially formed on the runner tube for pivotally securing a plurality of stretcher ribs of a rib assembly, which is provided for fastening an umbrella cloth on the rib assembly, by a fastening wire wound on the ferrule with the wire ends twisted and knotted in a socket formed on the inner ferrule; and a safety cover having a protective cap lockable on the ferrule for sheltering the wire ends in the socket of the ferrule, and having a pendent cover resiliently formed on a lower portion of the protective cap for sheltering a spring catch resiliently protruded from the central shaft for preventing injury to the user's finger as pricked by the spring catch.

3 Claims, 3 Drawing Sheets

SAFETY UMBRELLA RUNNER

This application is a continuation-in-part of U.S. patent application Ser. No. 09/040,373 filed on: Mar. 18, 1998, now U.S. Pat. No. 5,911.233, which is hereinafter called as "original application".

BACKGROUND OF THE INVENTION

The original application disclosed a safety umbrella runner including: a runner tube slidably held on a central shaft of the umbrella; an inner ferrule integrally circumferentially formed on the runner tube, adapted for pivotally securing a plurality of ribs for fastening an umbrella cloth on the ribs, by a fastening wire wound on the inner ferrule and having wire ends twisted and knotted in a socket formed in the inner ferrule; and an outer ferrule snugly engaged with and disposed outside the inner ferrule for sheltering the wire ends for preventing the user or worker from being pricked by the wire ends, and having a pendent cover protruding from the outer ferrule for sheltering a spring catch resiliently protruded from the central shaft for preventing injury to the user's finger by the spring catch.

However, the outer ferrule is formed with a plurality of outer ridges and outer furrows corrugatedly on the outer ferrule to be respectively corresponding to the inner ridges and furrows formed on the inner ferrule, and a shelter ridge ( 321*a*) formed on the outer ferrule for sheltering the wire ends knotted on the inner ferrule for preventing the user from being pricked by the wire ends. The outer ferrule may be further simplified to eliminate such outer ridges and furrows in order to save production cost and to enhance assembly convenience.

SUMMARY OF THE INVENTION

The object of the present invention is to provide a safety umbrella runner including: a runner tube slidably held on a central shaft of the umbrella; a ferrule integrally circumferentially formed on the runner tube for pivotally securing a plurality of stretcher ribs of a rib assembly, which is provided for fastening an umbrella cloth on the rib assembly, by a fastening wire wound on the ferrule with the wire ends twisted and knotted in a socket formed on the inner ferrule; and a safety cover having a protective cap lockable on the ferrule for sheltering the wire ends in the socket of the ferrule, and having a pendent cover resiliently formed on a lower portion of the protective cap for sheltering a spring catch resiliently protruded from the central shaft for preventing injury to the user's finger as pricked by the spring catch.

DETAILED DESCRIPTION

Figure 1:
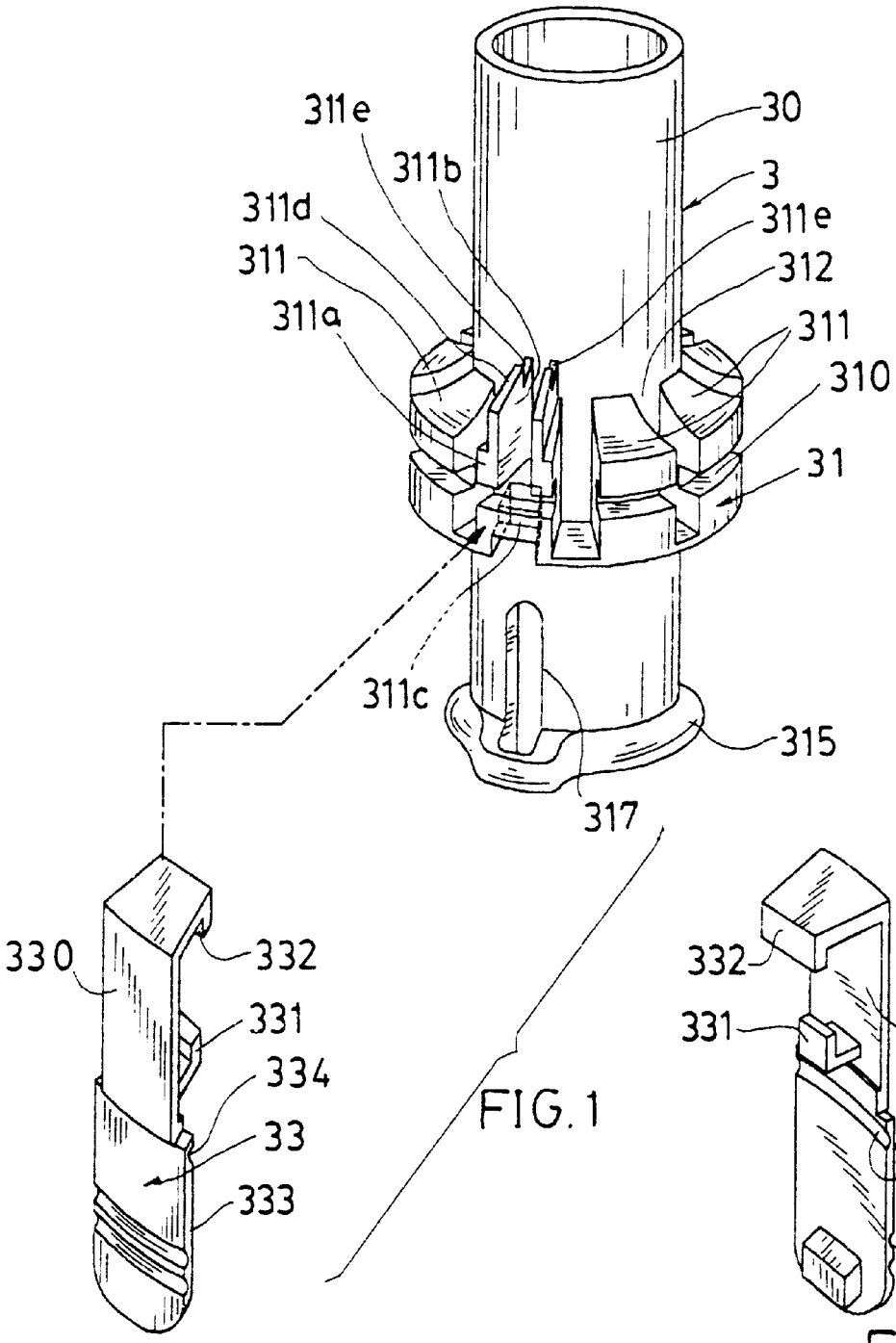
FIG. 1 is an exploded view of the present invention.
Figure 2:
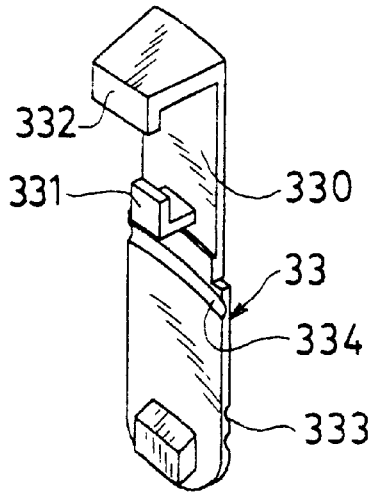
FIG. 2 is a perspective view of the safety cover of the present invention when viewed from an opposite direction of FIG. 1.
Figure 3:
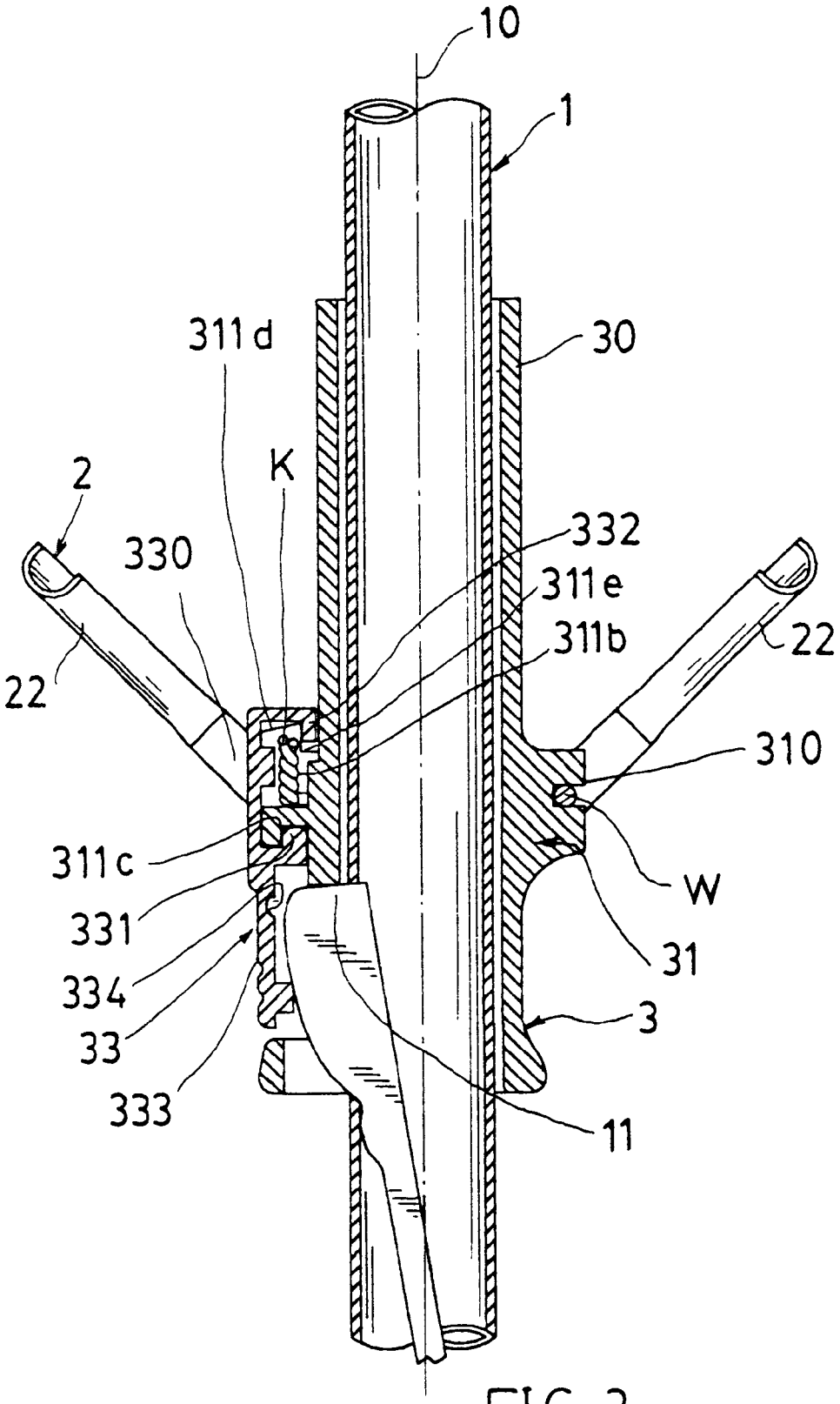
FIG. 3 is a sectional drawing of the present invention when held on a central shaft of an umbrella.

As shown in FIGS. 1~3, the safety runner 3 of the present invention includes: a runner tube 30 slidably held on a central shaft 1 for pivotally connecting a plurality of stretcher ribs 22 of a rib assembly 2 having an umbrella cloth (not shown) secured on the rib assembly; a ferrule 31 integrally formed on a middle and lower portion of the runner tube 30 for pivotally connecting each inner rib end of each stretcher rib 22 by a fastening wire W wound on the ferrule 31, and having a catch slot 317 longitudinally formed through a lower portion of the runner tube 30 for protruding a spring catch 11 resiliently held in the central shaft 1 for locking the runner 3 on the catch 11 when opening the umbrella; and a safety cover 33 engageable with the ferrule 31 for sheltering two wire ends as twisted and knotted from the wire W and for sheltering the spring catch 11.

The rib assembly 2 includes at least a top rib (not shown) pivotally secured to an upper notch fixed on a top of the central shaft 1 defining a longitudinal axis 10 at a longitudinal center of the shaft 1, and at least a stretcher rib 22 pivotally secured between the runner 3 and the top rib 21. Other structures or mechanisms of the rib assembly 2 may be formed or modified, not limited in the present invention.

The ferrule 31 includes: a plurality of ridges 311 and furrows 312 alternatively corrugatedly formed on the ferrule 31; an annular groove 310 annularly recessed in the ridges 311 for engaging a fastening wire W in the annular groove 310 for pivotally securing a plurality of stretcher ribs 22 of the rib assembly 2 on the fastening wire W with each stretcher rib 22 pivoted in each furrow 312 defined between every two neighboring ridges 311; a knot-holding ridge 311*a* formed on the ferrule 31 as inserted between two ridges 311 having a socket 311*b* recessed in the knot-holding ridge 311*a* for embedding a wire knot K by twisting two free wire ends of the fastening wire W, as wound in the annular groove 310, into the socket 311*b* in the knot-holding ridge 311*a*; a lower recess 311*c* recessed in a bottom portion of the knot-holding ridge 311*a* of the ferrule 31, an upper recess 311*e* recessed in an upper portion of the knot-holding ridge 311*a*, and a sloping surface 311*d* formed on a top surface of the knot-holding ridge 311*a* and inclined upwardly radially towards the longitudinal axis 10 of the shaft 1 (FIG. 3 ); a bottom extension ring 315 circumferentially formed on a bottom end of the runner tube 30; and a catch slot 317 longitudinally cut out in a lower portion of the runner tube 30 and projectively aligned with the knot-holding ridge 311*a* for outwardly protruding the spring catch 11 for locking the runner 3 on the shaft 1 for retaining the rib assembly 2 when opening the umbrella.

The safety cover 33 includes: a protective cap 330 having a lower hook 331 formed on a lower portion of the cap 330 and engageable with the lower recess 311*c* in the knot-holding ridge 311*a* of the ferrule 31 and having an upper hook 332 formed on an upper portion of the cap 330 and engageable with the upper recess 311*e* of the knot-holding ridge 311*a* for firmly securing the cap 330 on the knot-holding ridge 311*a* for sheltering the socket 311*b*; and a pendent cover 333 integrally formed on a lower portion of the protective cap 330 for sheltering the spring catch 11 as outwardly protruding from the catch slot 317 formed in the runner 3.

The safety cover 33 is formed with a groove 334 between the cap 330 and the pendent cover 333 for forming a resilient neck portion adjacent to the groove 334 on the cover 33 for resiliently restoring the pendent cover 333 outwardly after inwardly depressing the spring catch 11 for unlocking the runner 3 from the shaft 1 for closing the umbrella.

The sloping surface 311*d* of the ridge 311*a* provides a smooth "guide" for snugly engaging the upper hook 332 of the safety cover 33 with the upper recess 311*e* on the ridge 311*a*.

Figure 4:
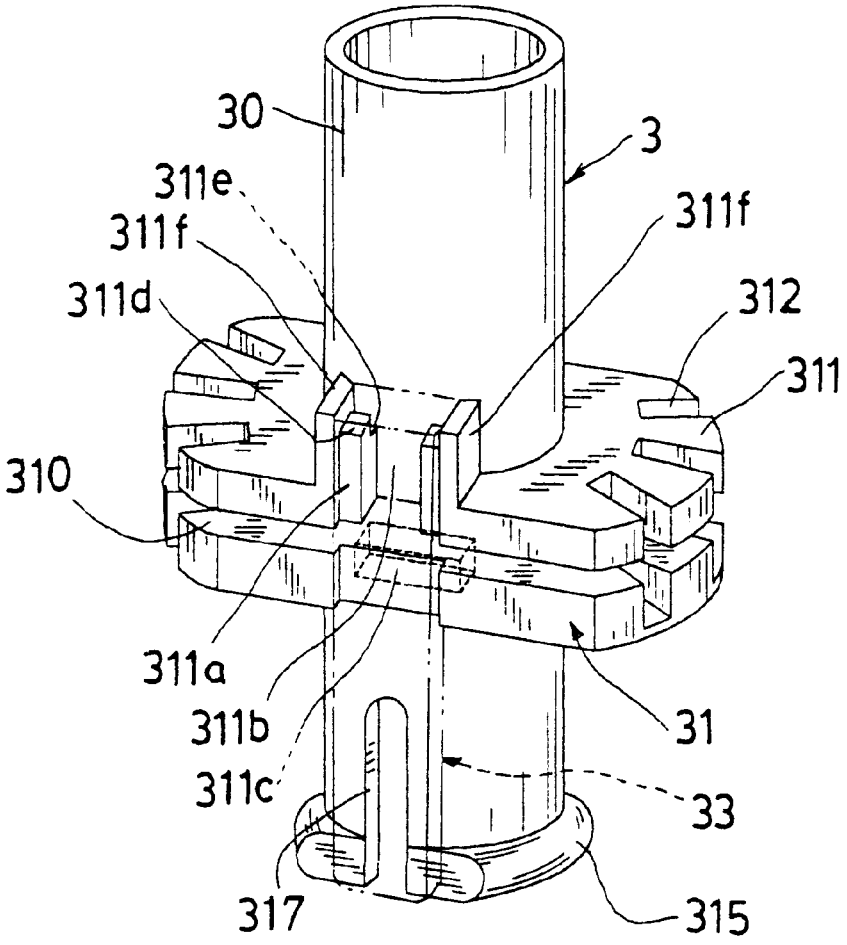
FIG. 4 is an exploded view of another preferred embodiment of the present invention.
Figure 4:
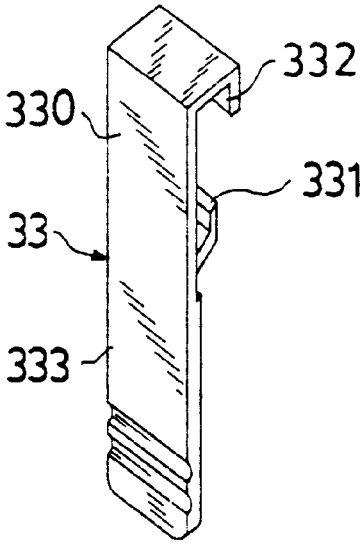

Another preferred embodiment of the present invention is shown in FIG. 4, which is modified to be used for a flat type umbrella having the runner 3 formed as flat or rectangular shape.

The ferrule 31 of FIG. 4 is formed as a flat or rectangular shape having the ridges 311 and the furrows 312 formed on opposite end portions of the flat or rectangular ferrule 31 for pivotally securing the ribs of the umbrella.

The wire knot K (not shown) is stored in the socket 311*b* recessed in the knot-holding ridge 311*a*, which is formed on a flat side portion of the ferrule 31 and the catch slot 317 is projectively aligned with the socket 311*b* for protruding the spring catch 11 outwardly for locking the runner 3 on the catch 11 when opening the umbrella.

The structure of the flat ferrule 31 of FIG. 4 is similar to that as shown in FIGS. 1~3. A pair of side walls 311*f* are formed on the ferrule 31 and disposed about opposite ends of the knot-holding ridge 311*a* for engaging the cap 330 in between the two side walls 311*f* on the ferrule 31.

The safety cover 33 is integrally formed as a compact one-piece member for an easy production as effected by plastic molding process, having the upper cap 330 for shielding the wire ends K in the socket 311*b* of the knot-holding ridge 311*a* and having the lower pendent cover 333 for sheltering the spring catch 11 to prevent injury as pricked either by the wire ends of the fastening wire W or by the spring catch 11 for safety purpose.

Just effected by a simple tiny piece of the safety cover, the wire ends and the spring catch can be fully protected to prevent their pricking injuries to the umbrella users.

This C-I-P application is superior to the original application for simpler structure, easy production, lower cost and quick assembly.

The present invention may be modified without departing from the spirit and scope of the present invention. For enriching the resilience of the cover 33, it may be made of elastomeric materials or other resilient materials.

I claim:

1. A safety umbrella runner comprising:

a runner tube slidably held on a central shaft and having a catch slot longitudinally formed through said tube for outwardly protruding a spring catch resiliently held in the central shaft;

a ferrule integrally formed on said runner tube for pivotally connecting thereon a plurality of ribs of a rib assembly for securing an umbrella cloth, having a fastening wire wound on said ferrule for pivotally connecting said ribs on said wire, said wire having two free wire ends twisted and knotted together, said ferrule having a knot-holding ridge formed on said ferrule to be projectively aligned with said catch slot and formed with a socket recessed in said knot-holding ridge for storing said wire ends of said fastening wire in said socket; and a safety cover engaging with said knot-holding ridge for sheltering said socket and said wire ends in said socket, and for sheltering said spring catch as outwardly protruded through said catch slot for locking said runner on said catch when opening the umbrella;

said ferrule of said runner including a lower recess recessed in a bottom portion of said knot-holding ridge and an upper recess recessed in an upper portion of said knot-holding ridge for engaging said safety cover with said two recesses; and said safety cover including: a protective cap having a lower hook formed on a lower portion of the cap and engaging with the lower recess in the knot-holding ridge and having an upper hook formed on an upper portion of the cap and engaging with the upper recess in the knot-holding ridge for firmly securing the cap on the knot-holding ridge for sheltering the socket of the wire ends; and a pendent cover integrally formed on a lower portion of the protective cap for sheltering said spring catch as outwardly protruding, from said catch slot formed in the runner.

2. A safety umbrella runner according to claim 1, wherein said safety cover is formed with a groove between the cap and the pendent cover for forming a resilient neck portion adjacent to the groove on the cover for resiliently restoring the pendent cover outwardly after inwardly depressing the spring catch for unlocking the runner from a central shaft for closing the umbrella.

3. A safety umbrella runner according to claim 1, wherein said knot-holding ridge is formed with a sloping surface on a top surface of said knot-holding ridge for providing a smooth guide for snugly engaging the upper hook of the safety cover with the upper recess on the knot-holding ridge.

* * * * *